US008633655B2

(12) United States Patent
Kao et al.

(10) Patent No.: US 8,633,655 B2
(45) Date of Patent: Jan. 21, 2014

(54) LED (LIGHT-EMITTING DIODE) OUTPUT POWER ADJUSTING DEVICE AND METHOD THEREOF

(75) Inventors: Jesse Kao, Taipei (TW); Berton Chuang, Taipei (TW)

(73) Assignee: Azurelighting Technologies, Inc., Taipei (TW)

( * ) Notice: Subject to any disclaimer, the term of this patent is extended or adjusted under 35 U.S.C. 154(b) by 586 days.

(21) Appl. No.: 12/882,494

(22) Filed: Sep. 15, 2010

(65) Prior Publication Data

US 2012/0062145 A1 Mar. 15, 2012

(51) Int. Cl.
*G05F 1/00* (2006.01)

(52) U.S. Cl.
USPC ..... 315/291; 315/247; 315/307; 315/312; 315/185 S

(58) Field of Classification Search
USPC ..... 315/291, 307–312, 185 S, 224, 247
See application file for complete search history.

(56) References Cited

U.S. PATENT DOCUMENTS 8,487,548 B2 * 7/2013 Shteynberg et al. ..... 315/291
8,569,976 B2 * 10/2013 Shteynberg et al. ..... 315/307

* cited by examiner

*Primary Examiner* — Tuyet Thi Vo
(74) *Attorney, Agent, or Firm* — Rosenberg, Klein & Lee

(57) ABSTRACT

An LED (Light-Emitting Diode) output power adjusting device includes an analog/digital conversion and detection circuit, a computation and control unit, a digital/analog conversion control circuit, and a power supply circuit. The analog/digital conversion and detection circuit is connected to an LED based load to detect a forward voltage thereof and converts the forward voltage into an output of digital signal. The computation and control unit perform evaluation and computation on the digital signal of the forward voltage to obtain a digital current control signal indicating a corresponding current. The digital/analog conversion control circuit converts the digital current control signal into an analog current control signal, which is then fed to a constant current drive circuit of the LED based load to adjust an output power of the LED based load to approximate a constant power condition. The power supply circuit supplies working powers for the analog/digital conversion and detection circuit, the computation and control unit, and the digital/analog conversion control circuit. Also disclosed is an LED output power adjusting method.

7 Claims, 5 Drawing Sheets

LED (LIGHT-EMITTING DIODE) OUTPUT POWER ADJUSTING DEVICE AND METHOD THEREOF

BACKGROUND OF THE INVENTION

1. Field of the Invention

The present invention relates to an LED (Light-Emitting Diode) output power adjusting device and a method thereof, and in particular to a device that controls the output power of an LED based load through detection of a forward voltage and a computation and evaluation process and a method thereof.

2. The Related Arts

An LED (Light-Emitting Diode) is a light source device, which emits light when being applied with a sufficient current across opposite ends thereof. However, an LED induces a forward voltage that is not a constant and may change with the variation of temperature or environmental factors. Thus, the output power of the LED is not of a constant power condition and may change with the variation of temperature and environmental factors.

Further, electrical loading formed of an LED lighting device that is constituted by composing a plurality of LEDs in the form of an array or lighting strips may not be capable of controlling variation of output power that is caused by the variation of the LEDs induced by change of temperature or environmental factors. Thus, an estimation process is often performed to ensure a desired output power. This is often done through "burning" of the lighting device, wherein the LED lighting device is put into operation for quite a period of time and then the output power of the lighting device is measured from which the output power of an actual operation of the lighting device is inferred. However, since an LED has an extensively long lifespan, the conventional way of burning, which is carried out for only a relatively short period of time, is not very precise in predicting the actual output power of the lighting device. Thus, significant errors are often found for the output current of which prediction and estimation are done through device burning so that the output power of the lighting device cannot be precisely controlled, making it difficult for the lighting device to operate with reduced power consumption.

Further, the known LED lighting devices often suffers constant change of output power caused by unstable forward voltage due to vibration of temperature. Thus, the conventional LED lighting devices must be tested with device burning on such an extent that the forward voltage of the LED get stable before a constant current power supply of an actual output be set and output power being controlled. This takes a large amount of valuable working hours and human labor, and thus leading to drawbacks of power throughput of LED lighting device manufacturing and high costs. Further, to ensure output power of a manufactured LED lighting device, a large rating power must be set in order to handle any insufficiency of output power after the lighting device has shipped to a user. This makes the conventional LED lighting devices not complying with the requirement of low power consumption for environmental conservation.

Various techniques in this respect are available, such as Taiwan Utility Model M350199 that provides a control system for extending lifespan of LED lighting, in which two set of LED lighting string are lit alternately to cope with the problem of temperature variation. However, device burning must be carried out in order to set the output power of the LED lighting strings. Further, this conventional arrangement requires two sets of LED lighting strings, which unnecessarily adds the manufacturing costs.

SUMMARY OF THE INVENTION

The conventional LED lighting devices are not capable of precisely controlling actual output power of the LED lighting devices due to variation of temperature or environmental factors. Further, an extended period of time is required for test through device burning in the manufacturing of LED lighting devices in order to determine the rated output power of the LED lighting devices. This makes the manufacturing time of LED lighting devices excessively long and the cost high and also makes the lighting devices so manufactured not complying the requirement of environmental protection and low power consumption.

Thus, it is desired to provide a device and a method that is low cost and burning free, shortens manufacturing time, and provides a precise and reliable way to eliminate factors that cause change of output power and provide constant level of power consumption, whereby a load of LED lighting device can be of excellent adjustment and control of output power and additional power consumption caused by variation of temperature or environmental factors can be reduced to thereby actually meet the requirement of lower power consumption and environmental conservation.

According to an aspect of the present invention, an LED output power adjusting device is provided, comprising an analog/digital conversion and detection circuit, a computation and control unit, a digital/analog conversion control circuit, and a power supply circuit. The analog/digital conversion and detection circuit is connected to an LED based load to detect a forward voltage thereof and converts the forward voltage into an output of digital signal. The computation and control unit perform evaluation and computation on the digital signal of the forward voltage to obtain a digital current control signal indicating a corresponding current. The digital/analog conversion control circuit converts the digital current control signal into an analog current control signal, which is then fed to a constant current drive circuit of the LED based load to adjust an output power of the LED based load to approximate a constant power condition. The power supply circuit supplies working powers for the analog/digital conversion and detection circuit, the computation and control unit, and the digital/analog conversion control circuit.

According to another aspect of the present invention, a method for adjusting LED output power is provided, comprising the following steps:

(A) process starting;

(B) forward voltage of LED device detected, wherein an analog/digital conversion and detection circuit is used to detect a forward voltage across a load of LED lighting device;

(C) detected forward voltage converted into digital signal, wherein the value of the forward voltage detected by the analog/digital conversion and detection circuit in step (B) is converted into a digital signal for output;

(D) evaluation made to determine if forward voltage is normal, wherein a computation and control unit is used to perform an evaluation process on the forward voltage output by the analog/digital conversion and detection circuit in step (C) and if the result of the evaluation is normal, then the process goes on to step (F); otherwise, the result of the evaluation is abnormal and the process goes on to step (E);

(E) output current set to minimum working current, wherein the computation and control unit of step (D) simply issues a digital current control signal associated with a value of the minimum working current of the LED lighting device and then the process goes on to step (G);

(F) output current computed and output, wherein the computation and control unit of step (D) determines the value of output current according to the relationship that power is equal to forward voltage multiplies electrical current under a constant power condition and issues a corresponding digital current control signal;

(G) value of output current converted into analog current control signal, wherein the current value of the digital current control signal issued by the computation and control unit in step (E) or (F) is converted by a digital/analog conversion control circuit into an analog current control signal; and (H) analog current control signal fed to constant current supply source for supply of current, wherein the analog current control signal that is supplied from the digital/analog conversion control circuit in step (G) is fed to a constant-current drive circuit of the load of LED lighting device, whereby the constant-current drive circuit supplies an electrical current corresponding to the current value set by the computation and control unit in step (E) or (F) to the LED device (for example an LED array) of the LED lighting device, so as to make the output power of the LED lighting device approximating a constant power condition and the process goes on to repeat step (B).

The advantage of the LED output power adjusting device of the present invention is automatic detection of forward voltage of a load of LED lighting device and performance of evaluation to determine if the forward voltage is normal and determining electrical current of the LED lighting device for feeding an analog current control signal to a constant current drive circuit of the LED lighting device so that the constant current drive circuit supplies a current of a target level to make the output power of the LED lighting device so adjusted as to approximate a constant power condition. In this way, the problem of the conventional LED lighting devices that the output power changes with the variation of temperature or environmental factors is eliminated. Further, in the manufacturing of LED lighting device according to the present invention, no device burning is needed for estimation and setting of the rated power, so that the costs and working hours needed for manufacturing the LED lighting device are reduced and true green environmental protection can be realized through reduced power consumption.

BRIEF DE DESCRIPTION OF THE DRAWINGS

The present invention will be apparent to those skilled in the art by reading the following description of a preferred embodiment thereof and the best mode for carrying out the present invention, with reference to the attached drawings, wherein.

DETAILED DESCRIPTION OF THE PREFERRED EMBODIMENT AND THE BEST MODE FOR CARRYING OUT THE PRESENT INVENTION

Figure 1:
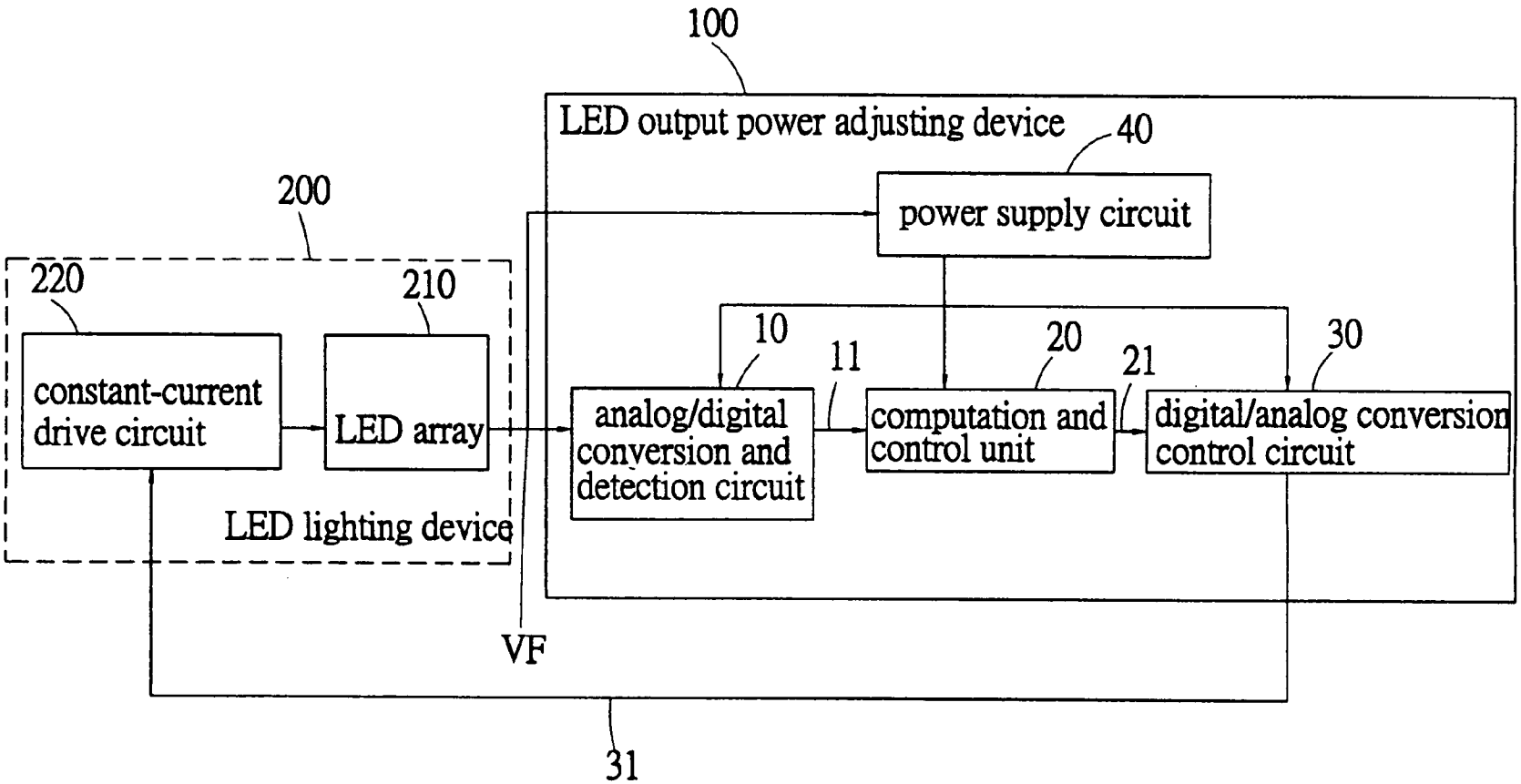
FIG. 1 is a block diagram of an LED (Light-Emitting Diode) output power adjusting device constructed in accordance with the present invention.

With reference to the drawings and in particular to FIG. 1, an LED (Light-Emitting Diode) output power adjusting device constructed in accordance with the present invention, generally designated at 100, comprises an analog/digital conversion and detection circuit 10, which is connectable to a load, which is constructed of an LED lighting device 200 in the example illustrated, to detect a forward voltage VF of the value induced across an LED array 210 of the LED lighting device 200 and to convert the detected forward voltage VF, which is analog, into a corresponding digital signal 11 for output. The load connected to the analog/digital conversion and detection circuit 10 is not limited to the example of LED lighting device 200 shown in the drawing and any other electrical load that is constituted by an equivalent LED array or a plurality of LED lighting strips are considered within the scope of application of the present invention.

A computation and control unit 20 is connected to the analog/digital conversion and detection circuit 10 to receive the digital signal 11 that is supplied from and converted by the analog/digital conversion and detection circuit 10 for performing evaluation processing on the forward voltage VF represented by the digital signal 11 in order to determine a level of current to be output. For example, when the forward voltage VF is of a normal value, considering the relationship output power (P)=the forward voltage (VF)×electrical current (I), with the output power P being set as a fixed given value, such as an output of 50 W, and the forward voltage VF being 33V, the current I is approximately 1.515 A. The computation and control unit 20 then issues a digital current control signal 21 corresponding to the level of the current I. In case that the forward voltage VF exceeds a normal range, meaning the forward voltage VF is abnormal, the computation and control unit 20 simply sets the current I to a minimum working current $I_{min}$, and the digital current control signal 21 issued in association with such a condition is set to correspond the minimum working current, making the output power P close to the preset output power of 50 W. The computation and control unit 20 is not limited to any specific form, and a microprocessor unit is taken as an example herein.

A digital/analog conversion control circuit 30 is connected to the computation and control unit 20 and a constant-current drive circuit 220 of the LED lighting device 200 in order to convert the digital current control signal 21 issued by the computation and control unit 20 into an analog current control signal 31 that indicates the corresponding level of electrical current. The analog current control signal 31 is fed to the constant-current drive circuit 220 of the LED lighting device 200, whereby the constant-current drive circuit 220 applies an electrical current that is obtained according to the evaluation and computation made in the computation and control unit 20 to drive the LED array 210 of the LED lighting device 200. Thus, the present invention shows an advantage of setting output power of a load of an LED lighting device 200 approximating a constant power condition.

A power supply circuit 40 is connected to the analog/digital conversion and detection circuit 10, the computation and control unit 20, and the digital/analog conversion control circuit 30 to supply direct-current (DC) working powers to the analog/digital conversion and detection circuit 10, the computation and control unit 20, and the digital/analog conversion control circuit 30. The supply of power with the power supply circuit 40 is not limited to any specific form and in the embodiment illustrated, a power supply connected to the LED array 210 of the LED lighting device 200 is taken as an example, of which the electrical power is converted into DC working powers supplied to the analog/digital conversion and detection circuit 10, the computation and control unit 20, and the digital/analog conversion control circuit 30. Other examples of the power supply circuit 40 may comprise DC batteries or a power supply device constituted by an AC/DC converter that supplies an output of direct current. These are all considered within the scope of the present invention. In other words, the LED output power adjusting device 100 according to the present invention can be combined with the LED lighting device 200, or it is alternatively set as a separate circuit for connection with the LED lighting device 200.

Figure 2:
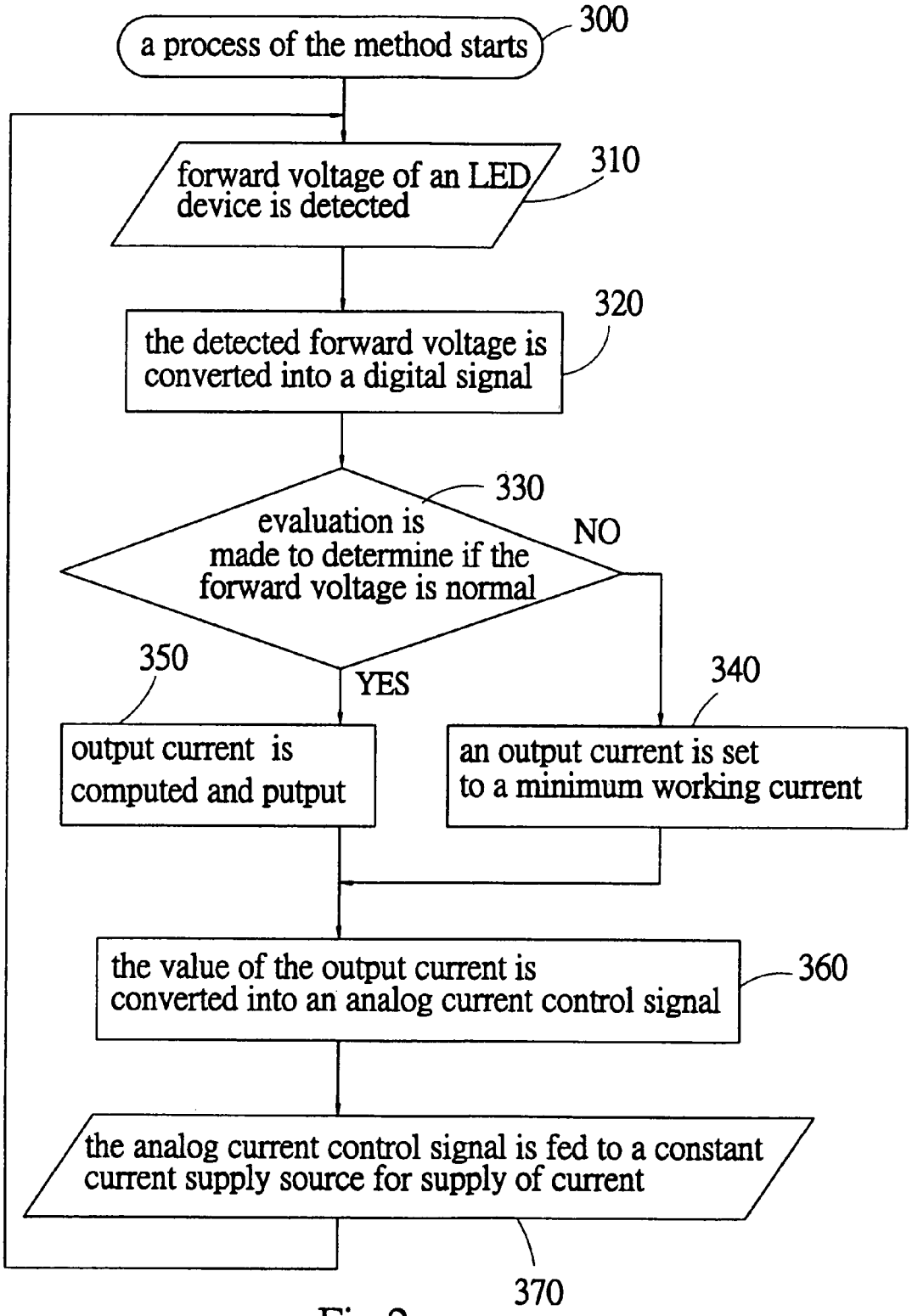
FIG. 2 is a flow chart showing an LED output power adjusting method according to the present invention.

Referring to FIG. 2, a flow chart showing a method for adjusting LED output power according to the present invention is given. The method of the present invention comprises the following steps:

Step 300, where a process of the method starts;

Step 310, where forward voltage of an LED device is detected, wherein an analog/digital conversion and detection circuit 10 is used to detect a forward voltage VF across a load of an LED lighting device 200;

Step 320, where the detected forward voltage is converted into a digital signal, wherein the value of the forward voltage VF detected by the analog/digital conversion and detection circuit 10 in Step 310 is converted into a digital signal 11 for output;

Step 330, where evaluation is made to determine if the forward voltage is normal, wherein a computation and control unit 20 is used to perform an evaluation process on the forward voltage VF output by the analog/digital conversion and detection circuit 10 in Step 320 and if the result of the evaluation is normal, then the process goes on to Step 350; otherwise, the result of the evaluation is abnormal and the process goes on to Step 340;

Step 340, where an output current is set to a minimum working current, wherein the computation and control unit 20 of Step 330 simply issues a digital current control signal 21 associated with a value of the minimum working current ($I_{min}$) of the LED lighting device 200 and then the process goes on to Step 360;

Step 350, where output current is computed and output, wherein the computation and control unit 20 of Step 330 determines the value of output current I according to the relationship: output power (P)=the forward voltage (VF)× electrical current (I), with the output power P being set as a fixed given value and issues a corresponding digital current control signal 21;

Step 360, where the value of the output current is converted into an analog current control signal, wherein the current value of the digital current control signal issued by the computation and control unit 20 in Step 340 or 350 is converted by a digital/analog conversion control circuit 30 into an analog current control signal 31; and Step 370, where the analog current control signal is fed to a constant current supply source for supply of current, wherein the analog current control signal 31 that is supplied from the digital/analog conversion control circuit 30 in Step 360 is fed to a constant-current drive circuit 220 of the load of LED lighting device 200, whereby the constant-current drive circuit 220 supplies an electrical current corresponding to the current value set by the computation and control unit 20 in Step 340 or 350 to the LED device (for example a LED array 210) of the LED lighting device 200, so as to make the output power P of the LED lighting device 200 approximating a constant power condition and the process goes on to repeat Step 310.

Figure 3:
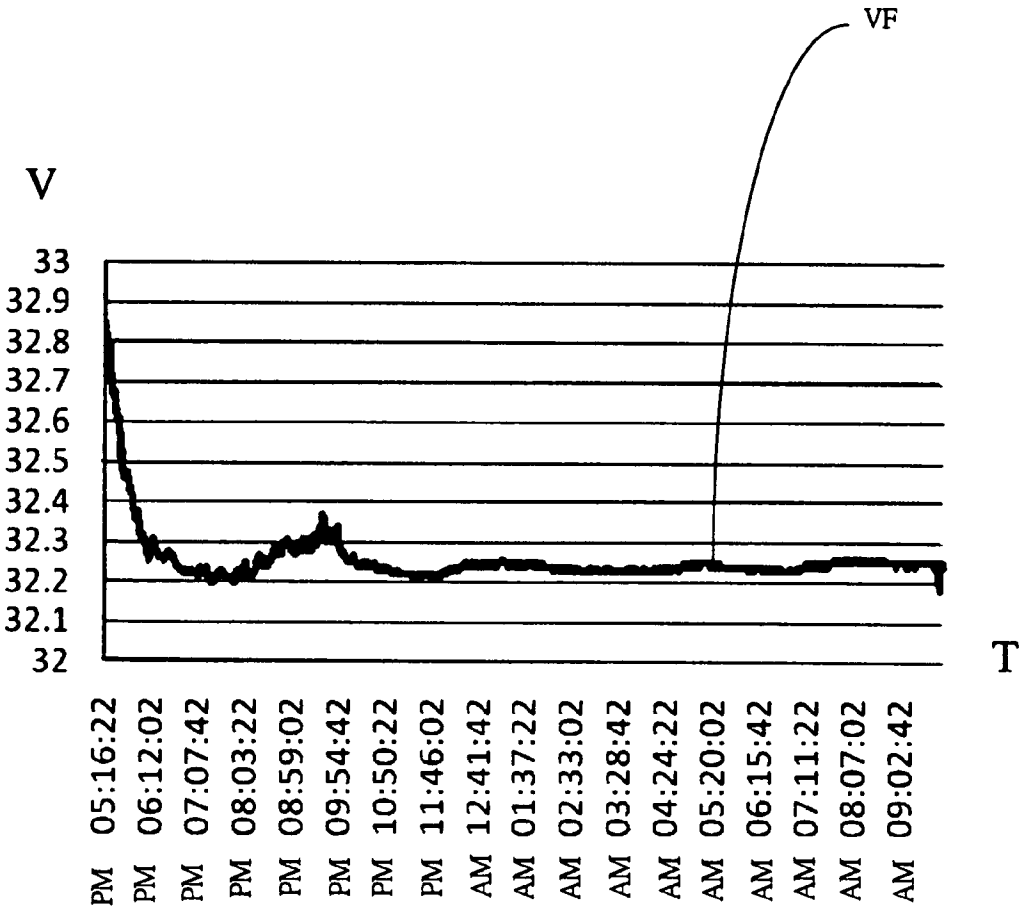
FIG. 3 is a plot showing a curve of forward voltage of a load of LED lighting device to which the present invention is applied.

Referring to FIG. 3, a plot of data obtained through experiments for the forward voltage VF of the LED output power adjusting device 100 according to the present invention is shown, which shows a curve of the forward voltage VF of the LED array 210 of the LED lighting device 200 with respect to time, indicating that the forward voltage VF varies with temperature or environmental factors. In the plot, the vertical axis is voltage (V) and the horizontal axis is time (T). This curve is a function curve of the forward voltage VF obtained through practical detection by the analog/digital conversion and detection circuit 10.

Figure 4:
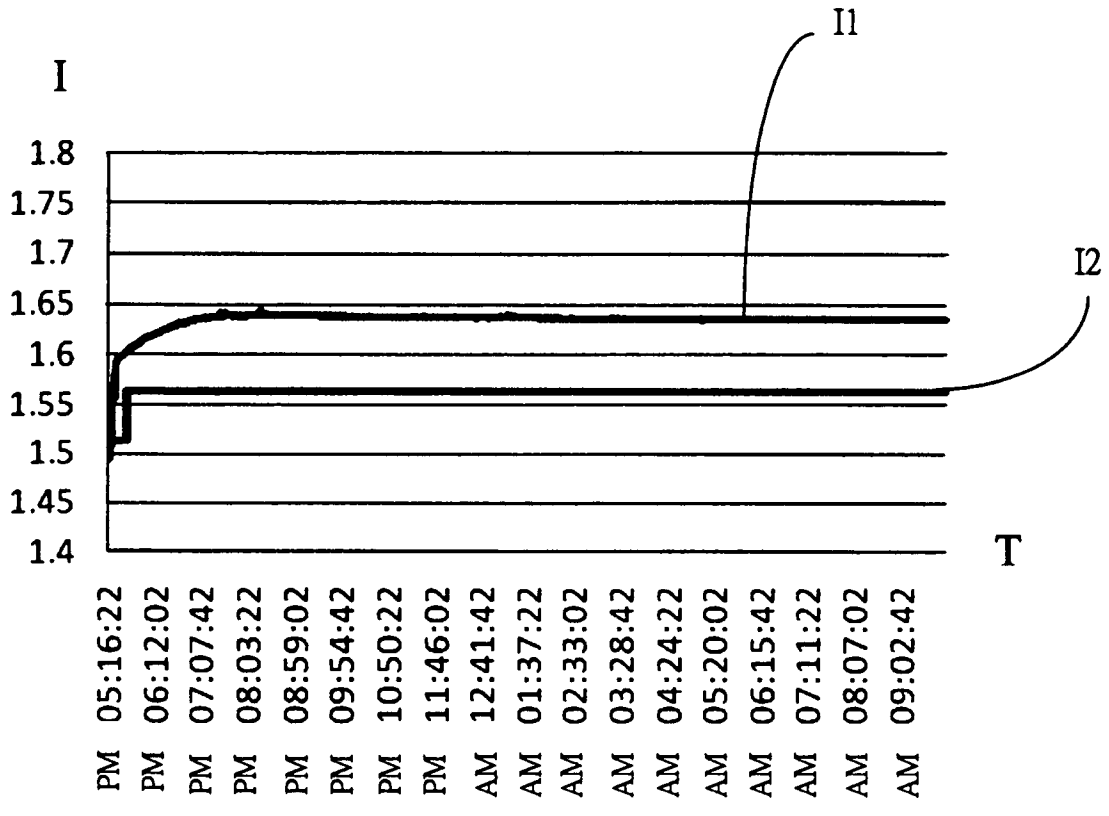
FIG. 4 shows curves of electrical currents obtained through tests carried out on loads of LED lighting device without and with the LED output power adjusting device according to the present invention.

Referring to FIG. 4, current curves for an LED lighting device that is not equipped with the LED output power adjusting device 100 according to the present invention and an LED lighting device 200 that is equipped with the LED output power adjusting device 100 according to the present invention are shown for comparison, wherein the first current curve I1 is a current curve for a device without the LED output power adjusting device 100 according to the present invention 100, and the second current curve I2 is a current curve associated with a device with the LED output power adjusting device 100 according to the present invention. In the plot, the vertical axis is electrical current (I) and the horizontal axis is time (T). A comparison between the first current curve I1 and the second current curve I2 reveals that the first current curve I1 required a longer time to get stable and also the first current curve I1 has a higher value, which is averagely around 1.6-1.65 A. This is the reason that a conventional LED lighting device requires preliminary burning for at least two hours before it reaches a result approximating actual operation. On the other hand, the LED output power adjusting device 100 according to the present invention makes it possible to automatically reach a stable condition in a short period of time as indicated by the second current curve I2, and further, the value of the second current curve I2, which is averagely around 1.55 A, is far less than that of the first current curve I1.

Figure 5:
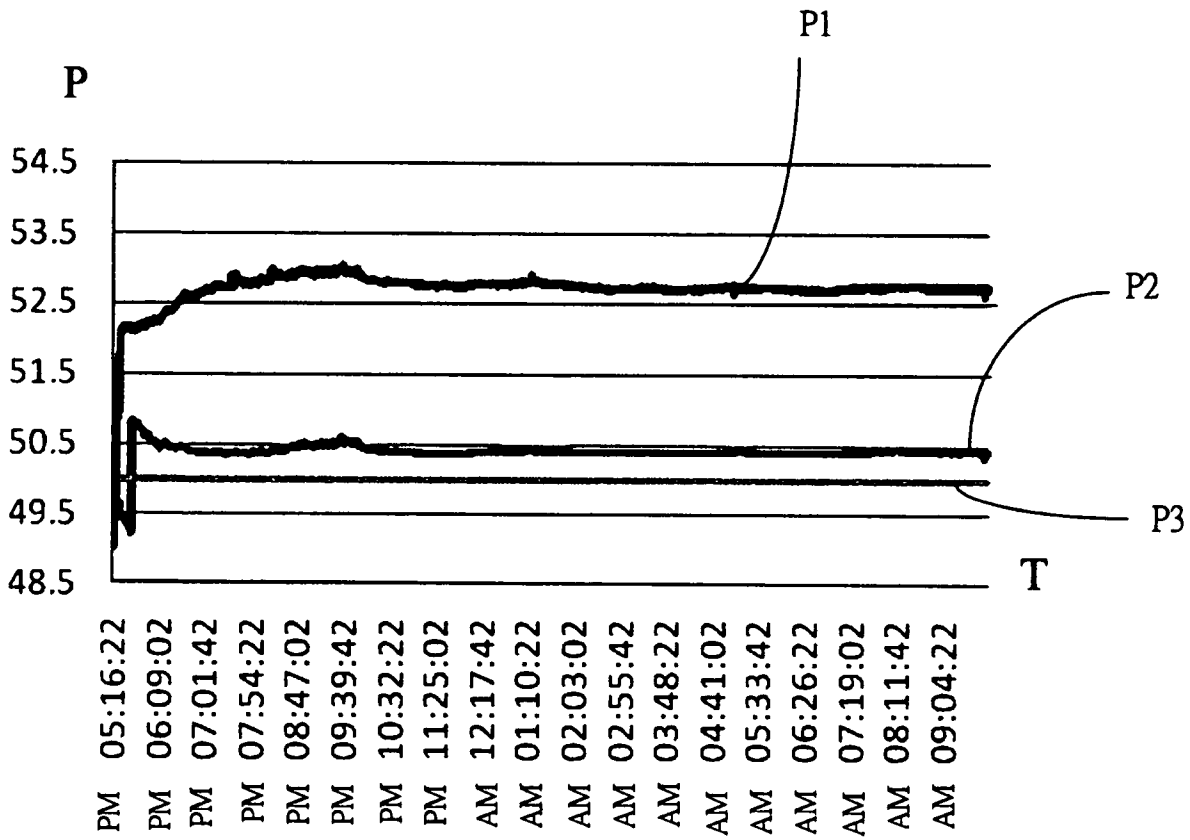
FIG. 5 shows curves of output powers obtained through tests carried out on loads of LED lighting device without and with the LED output power adjusting device according to the present invention.

Referring to FIG. 5, output power curves for an LED lighting device without the LED output power adjusting device 100 according to the present invention and a n LED lighting device 200 with the LED output power adjusting device 100 according to the present invention 100 are shown for comparison, wherein the first power curve P1 is an output power curve for a device without the LED output power adjusting device 100 according to the present invention, the second power curve P2 is an output power curve of a device with the LED output power adjusting device 100 according to the present invention, and the third power curve P3 indicates a curve of preset output power, such as the 50 W setting of output power mentioned in an above discussed example. The vertical axis is output power (P) and the horizontal axis is time (T). A comparison between the first power curve P1 and the second power curve P2 indicates that the first power curve P1 requires a longer period of time to reach a stable value and also the first power curve P1 shows a higher value of power, of which an average exceeds 52.5V. This is the reason that a conventional LED lighting device requires preliminary burning for at least two hours before it reaches a result approximating actual operation. On the other hand, the LED output power adjusting device 100 according to the present invention makes it possible to automatically adjust a load of LED lighting device 200 to reach a stable condition in a short period of time as indicated by the second power curve P2 and close to the constant power condition indicated by the third power curve P3. Further, the value of the second power curve P2, which is averagely around 50.5 W, is far less than that of the first power curve P1.

Comparisons made among the forward voltage VF, the first current curve I1, the second current curve I2, the first power curve P1, the second power curve P2, and the third power curve P3 shown in FIGS. 2-4 reveal that through closed-loop type computation performed with each circuit of the analog/digital conversion and detection circuit 10, the computation and control unit 20, and the digital/analog conversion control circuit 30, the output current of the LED lighting device 200 can be precisely acquired and the output power is dynamically maintained in a condition close to an ideal constant power condition as indicated by the third power curve P3 without undesired changes caused by variation of temperature, environmental factors, and other factors. There is not need for long time burning of the device as required by the conventional lighting device for adjustment and test. The throughput can thus be improved. Further, since the output power is almost constant, there is no need to provide additional capacity for handling insufficiency of output power. This reduces a waste of the unnecessary power output and thus helps improving power saving. Thus, manufacturing efficiency can be improved and manufacturing cost reduced; and applicability is expanded to cover all sorts of LED based loading.

Although the present invention has been described with reference to the preferred embodiment thereof and the best mode of practicing the present invention, it is apparent to those skilled in the art that a variety of modifications and changes may be made without departing from the scope of the present invention which is intended to be defined by the appended claims.

What is claimed is:

1. An LED output power adjusting device, comprising:

an analog/digital conversion and detection circuit, which is connected to a load of an LED lighting device to detect an analog forward voltage of an LED array of the LED lighting device and to convert the analog forward voltage into a corresponding digital signal;

a computation and control unit, which is connected to the analog/digital conversion and detection circuit for performing evaluation processing on the digital signal of the forward voltage supplied from the analog/digital conversion and detection circuit in order to determine an output current and supplying a digital current control signal corresponding to the output current;

a digital/analog conversion control circuit, which is connected to the computation and control unit and a constant-current drive circuit of the LED lighting device to convert the digital current control signal from the computation and control unit into a corresponding analog current control signal and to feed the analog current control signal to the constant-current drive circuit of the LED lighting device, so that the constant-current drive circuit applied the output current that is obtained through the evaluation and computation of the computation and control unit to drive the LED array of the LED lighting device in order to make an output power of the LED lighting device approximating a constant power condition; and a power supply circuit, which is connected to the analog/digital conversion and detection circuit, the computation and control unit, and the digital/analog conversion control circuit to supply working powers to the analog/digital conversion and detection circuit, the computation and control unit, and the digital/analog conversion control circuit.

2. The LED output power adjusting device as claimed in claim 1, wherein the computation and control unit comprises a microprocessor unit.

3. The LED output power adjusting device as claimed in claim 1, wherein the power supply circuit is connected to a power source of the load of LED lighting device to which the analog/digital conversion and detection circuit is connected.

4. A method for adjusting LED (Light-Emitting Diode) output power, comprising the following steps:

(a) processing starting;

(b) forward voltage detected, wherein an analog/digital conversion and detection circuit is used to detect a forward voltage across a load of LED lighting device;

(c) detected forward voltage converted into digital signal, wherein value of the forward voltage detected by the analog/digital conversion and detection circuit in step (b) is converted into a digital signal for output;

(d) evaluation made to determine if forward voltage is normal, wherein computation and control unit is used to perform an evaluation process on the forward voltage output by the analog/digital conversion and detection circuit in step (c) and if the result of the evaluation is normal, then the process goes on to step (f); otherwise, the result of the evaluation is abnormal and the process goes on to step (e);

(e) output current set to minimum working current, wherein the computation and control unit of step (d) simply issues a digital current control signal associated with a value of the minimum working current of the LEE) lighting device and then the process goes on to step (g);

(f) output current computed and output, wherein the computation and control unit of step (d) determines the value of output current according to a predetermined relationship among output power, forward voltage, and electrical current under a constant power condition and issues a corresponding digital current control signal;

(g) value of output current converted into analog current control signal, wherein the current value of the digital current control signal issued by the computation and control unit in step (e) or (f) is converted by a digital/analog conversion control circuit into an analog current control signal; and (h) analog current control signal fed to constant current supply source for supply of current, wherein the analog current control signal that is supplied from the digital/analog conversion control circuit in step (g) is fed to a constant-current drive circuit of the load of LED lighting device, whereby the constant-current drive circuit supplies an electrical current corresponding to the current value set by the computation and control unit in step (e) or (f) to an LED array of the LED lighting device and the process goes on to repeat step (b).

5. The method as claimed in claim 4, wherein the computation and control unit of step (d) comprises a microprocessor unit.

6. The method as claimed in claim 4, wherein in step (f) the predetermined relationship among output power, forward voltage, and electrical current applied by the computation and control unit is that output power is equal to forward voltage times electrical current.

7. The method as claimed in claim 4, wherein in step (h), output power of the LED lighting device is made approximating a constant power condition.

* * * * *